United States Patent [19]

Bedwell et al.

[11] Patent Number: 4,722,457

[45] Date of Patent: Feb. 2, 1988

[54] DISPENSING DEVICE

[75] Inventors: Hubert A. Bedwell; Ronald C. Dreyer, Cincinnati, both of Ohio

[73] Assignee: Fibre Glass-Evercoat Company, Inc., Cincinnati, Ohio

[21] Appl. No.: 903,970

[22] Filed: Sep. 5, 1986

[51] Int. Cl.[4] ..... B65D 35/28

[52] U.S. Cl. ..... 222/103; 222/105

[58] Field of Search ..... 222/103, 95, 214, 97, 222/105, 106, 92, 101

[56] References Cited

U.S. PATENT DOCUMENTS

| | | | |
|---|---|---|---|
| 1,507,464 | 9/1924 | Clegg | 222/103 |
| 2,857,079 | 10/1958 | Hall | 222/103 |
| 3,543,966 | 12/1970 | Ryan et al. | 222/94 |
| 3,675,822 | 7/1972 | Casali et al. | 222/103 |
| 4,284,209 | 8/1981 | Barbour, Jr. | 222/103 X |
| 4,315,732 | 2/1982 | Rowbottam et al. | 222/103 X |
| 4,326,647 | 4/1982 | Pool | 222/103 |
| 4,349,133 | 9/1982 | Christine | 222/214 X |
| 4,424,917 | 1/1984 | Berger et al. | 222/103 |
| 4,448,329 | 5/1984 | Vilaseca et al. | 222/103 X |
| 4,645,094 | 2/1987 | Acklin et al. | 222/103 X |

*Primary Examiner*—Joseph J. Rolla
*Assistant Examiner*—Nils Pedersen
*Attorney, Agent, or Firm*—James W. Pearce; Roy F. Schaeperklaus

[57] ABSTRACT

A machine for causing discharge of plastic material from a bag-like container having flexible walls. The machine includes a first plate-like member pivotally mounted on the framework and a second plate-like member pivotally mounted on the framework. A spring urges the plate-like members together to grip the bag-like container therebetween. A free edge of the second plate-like member is urged toward the first plate-like member to squeeze the bag-like container. A spout receives contents of the bag-like container as the bag-like container is squeezed.

4 Claims, 11 Drawing Figures

DISPENSING DEVICE

BACKGROUND OF THE INVENTION

This invention relates to a machine for causing discharge of plastic material from a bag-like container having flexible walls.

An object of this invention is to provide such a machine in which walls of the container are squeezed between plate-like members to cause discharge of the plastic material through an opening in one of the walls of the container.

A further object of this invention is to provide such a machine in which at least one of the plate-like members is provided with a convex face which rolls with reference to the other plate-like member to provide a rolling action on the bag-like container as contents of the container are discharged.

BRIEF DESCRIPTION OF THE INVENTION

Briefly, this invention provides a machine having a rectangular framework inside which a first plate-like member is pivotally mounted adjacent one side of the framework and a second plate-like member is pivotally mounted adjacent an opposite side of the framework. A bag-like container is positioned between the plate-like members. A free edge of a lower one of the plate-like members is urged upwardly by spring members to grip a portion of the container against an upper one of the plate-like members. An operating lever is fulcrumed on the framework and can bear on a free end portion of the upper of the plate-like members to urge the plate-like members in container compressing direction. A nozzle is provided in the container through which contents of the container are discharged.

BRIEF DESCRIPTION OF THE DRAWINGS

The above and other objects and features of the invention will be apparent to those skilled in the art to which this invention pertains from the following detailed description and the drawings, in which.

DESCRIPTION OF PRESENTLY PREFERRED EMBODIMENT

Figure 1:
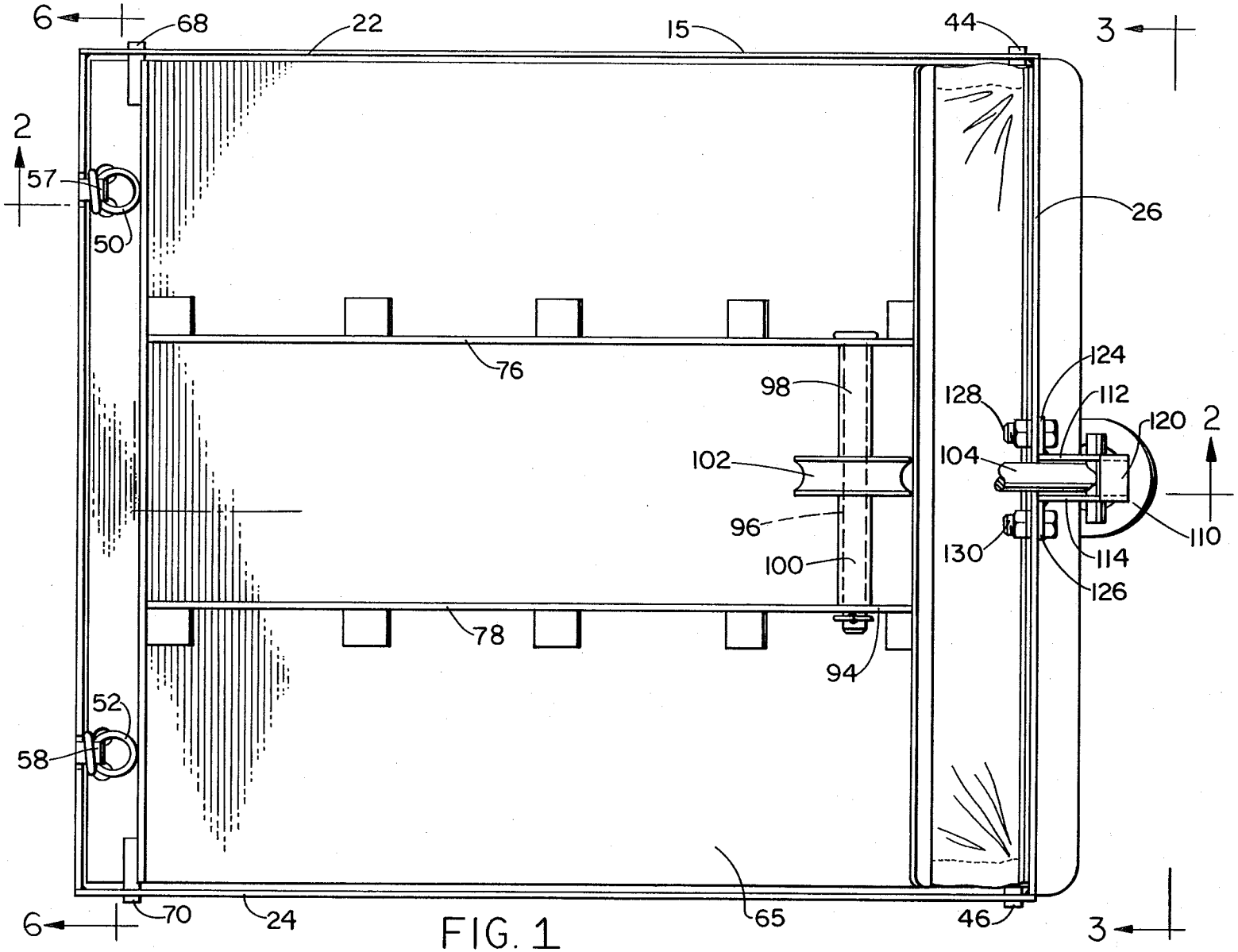
FIG. 1 is a top plan view of a machine for discharging plastic material from a bag-like container which is constructed in accordance with an embodiment of the invention.

In the following detailed description and the drawings, like reference characters indicate like parts.

Figure 2:
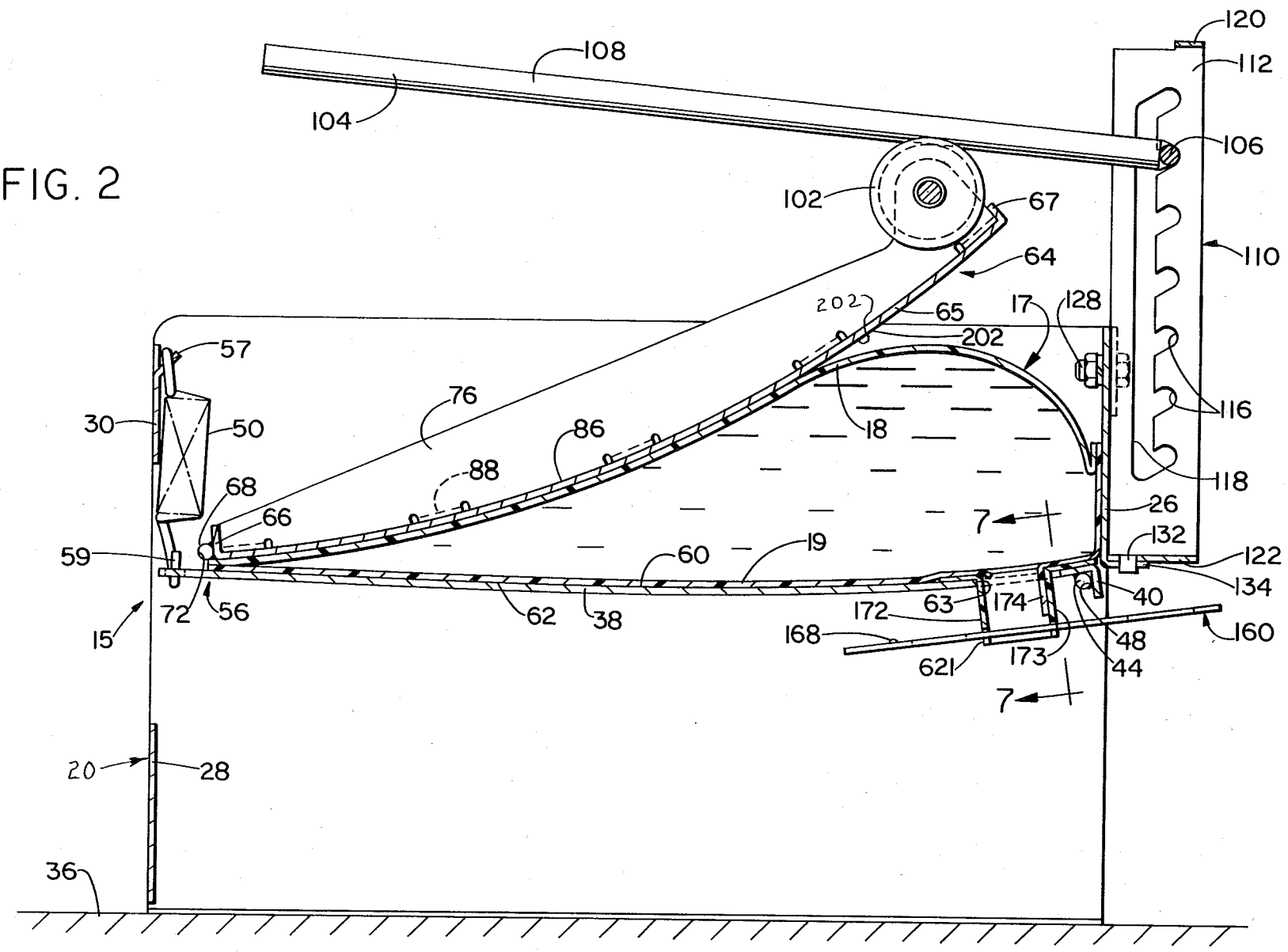
FIG. 2 is a view in section taken on the line 2—2 in FIG. 1.
Figure 3:
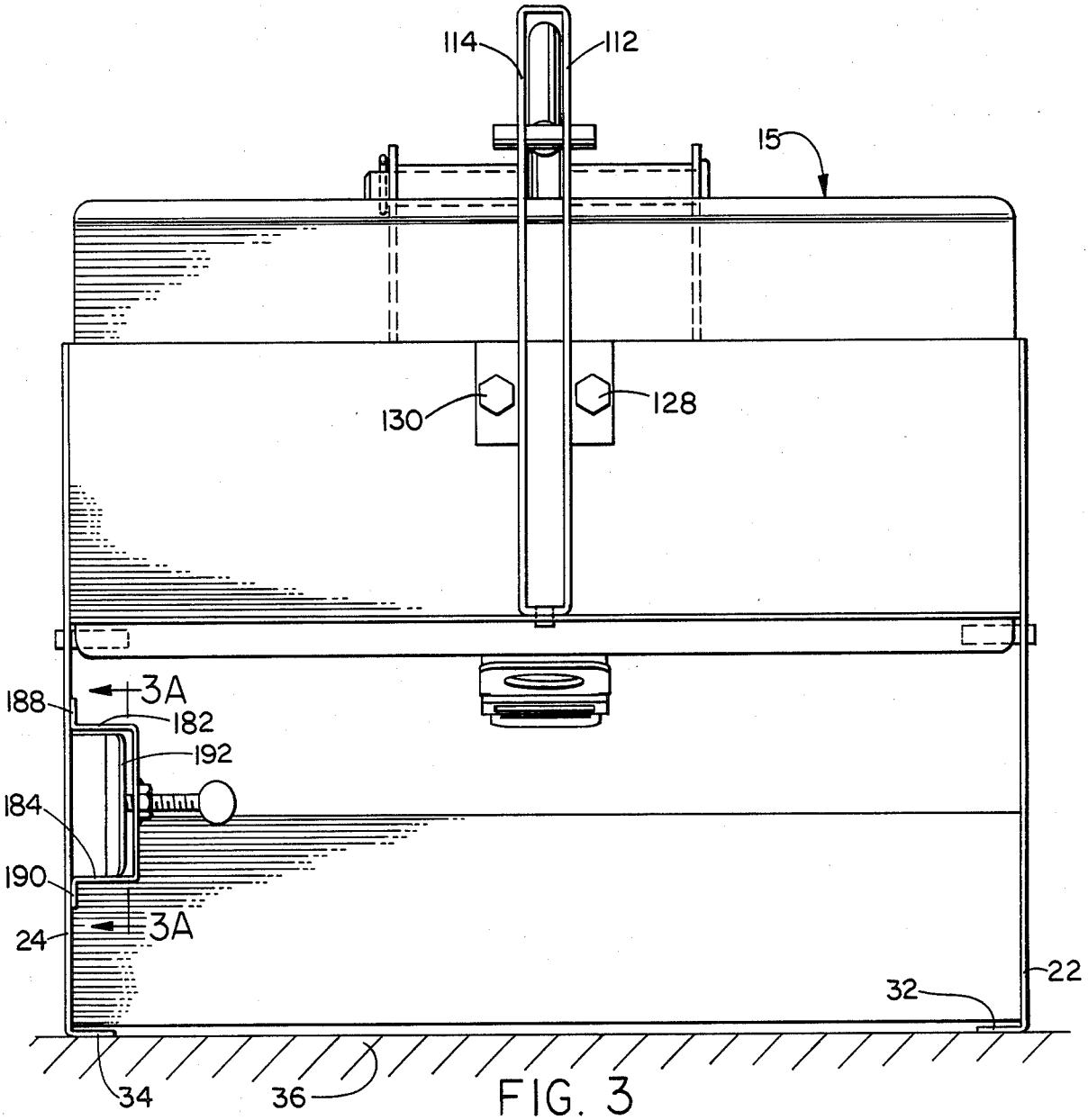
FIG. 3 is a view in end elevation looking in the direction of the arrows 3—3 in FIG. 1.
Figure 6:
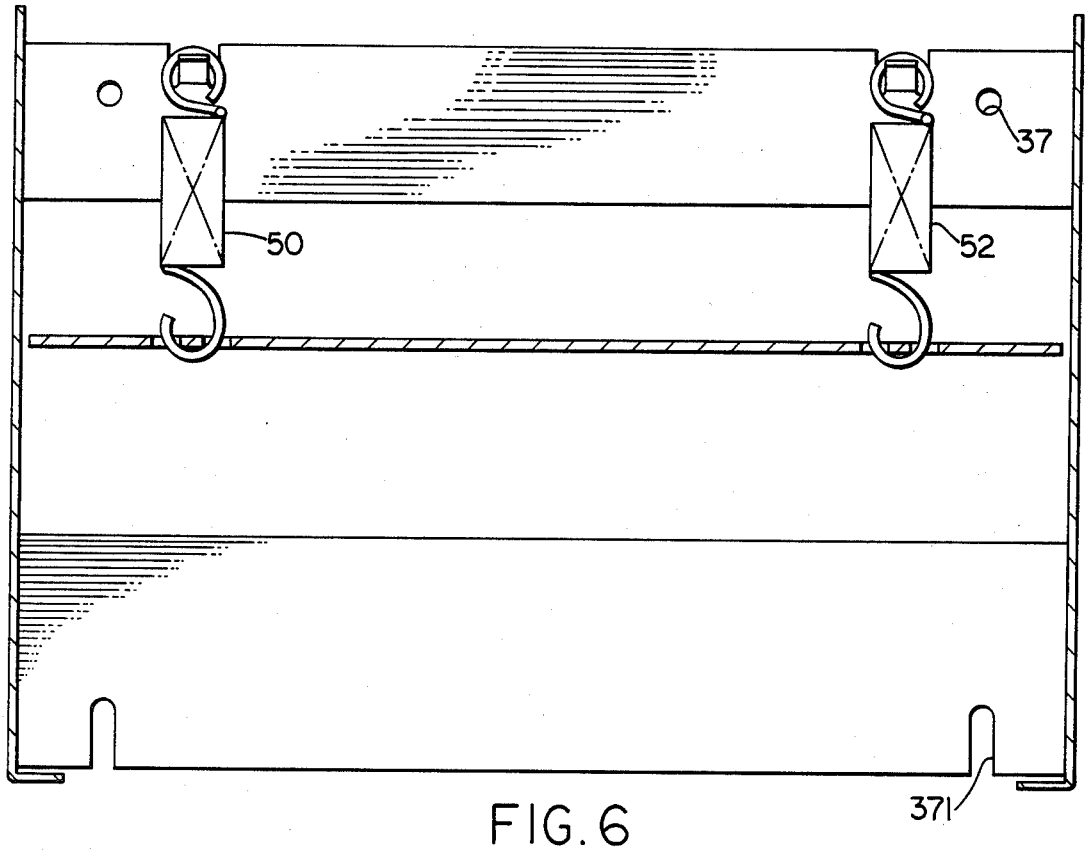
FIG. 6 is a view in section taken on the line 6—6 in FIG. 1.

In FIGS. 1–3 inclusive is shown a machine 15 for causing discharge of plastic material from a bag-like container 17 having flexible walls 18 and 19, which machine is constructed in accordance with an embodiment of this invention. The machine 15 includes a hollow rectangular framework 20 including side plates 22 and 24, a front end plate 26, a lower rear end plate 28 and an upper rear end plate 30. Flanges 32 and 34 on lower edges of the side plates 22 and 24, respectively, are located on lower edges of the side plates 22 and 24, respectively, and serve to support the machine on a proper horizontal support surface 36 as shown in FIG. 3. Openings 37 (FIG. 6) in the upper rear end plate 30 and slots 371 in the lower rear end plate 28 can be used to hang the machine on a wall (not shown).

A lower plate-like member 38 (FIG. 2) carries an angle member 40 along one edge thereof. Bearing pins 44 and 46 (FIG. 1) are mounted in the angle member 40 and extend outwardly through bearing openings 48 in the side plates 22 and 24 so that the plate-like member 38 can swing on the axis of bearing pins 44 and 46. Tension springs 50 and 52 are connected to the lower plate-like member 38 at an opposite end portion 56 thereof and urge the opposite end portion 56 thereof upwardly. Upper ends of the springs 50 and 52 are mounted on prong portions 57 and 58 of the upper rear end plate 30. A lower end portion 59 of the spring 50 is mounted in openings 591 and 592 in the lower plate-like member 38. Openings 593 and 594 in the lower plate-like member 38 receive a lower end portion 596 of the spring 52. The bag-like container 17 rests on the plate-like member 38. The plate-like member 38 is mounted in a substantially horizontal position. A face 60 of the plate-like member 38, which engages a lower face 62 of the bag-like container, is slightly concave upwardly. The plate-like member 38 is provided with an opening 63 through which a spout portion 621 of the bag-like container 17 projects.

Figure 8:
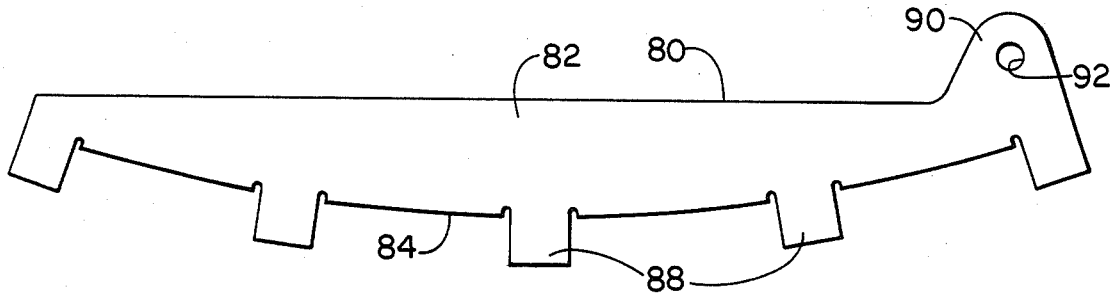
FIG. 8 is a plan view of a blank from which a stiffener of the machine is formed.

An upper plate-like member 64 includes a body portion 65 and flanges 66 and 67 at opposite ends of the body portion 65. Pivot pins 68 and 70 are mounted on the flange 66 and extend through bearing openings 72 in the side plates 22 and 24. Two stiffener plates 76 and 78 are mounted on the body portion 65. In FIG. 8 is shown a blank 80 from which the stiffener plate 76 is formed. The blank from which the stiffener plate 78 is formed is generally similar. The blank 80 includes a body 82 having an edge 84 which is generally complementary to an upper face 86 of the body portion 65, tabs 88 along the edge 84, and an upwardly extending extension 90, which is provided with an opening 92. The tabs 88 can be bent at right angles to the body 82 to engage flatwise with the plate-like member 64, and the tabs 88 can be welded to the plate-like member 64. The upwardly extending extension 90 and a similar upwardly extending extension 94 associated with the stiffener plate 78 support a shaft 96. Spacer sleeves 98 and 100 are mounted on the shaft 96 and position a pulley 102 on the shaft 96.

Figure 9:
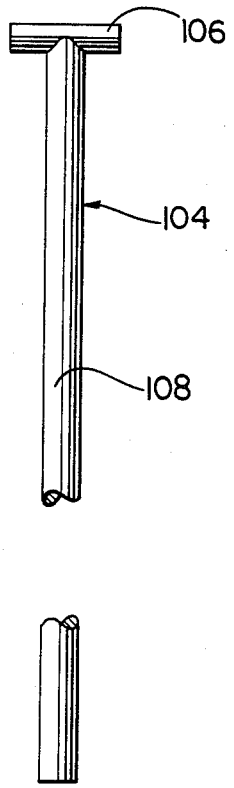
FIG. 9 is a fragmentary plan view of an operating handle of the machine.

The pulley 102 is engaged by an operating handle 104. The operating handle 104 is generally of T-shape and includes a cross bar head 106 and an elongated handle portion 108 as shown in FIGS. 2 and 9. The cross head 106 works in a housing 110. The housing 110 includes spaced parallel upright side plates 112 and 114. Details of construction of the side plate 112 are shown in FIG. 2. A series of sloping slots 116 is formed in the side plate 112. The sloping slots 116 are connected by an upright slot 118. The side plate 114 is of similar construction. Each of the sloping slots 116 can receive an end portion of the cross bar head 106 as shown in FIG. 2 with the handle portion 108 engaging the pulley 102. When the cross bar head 106 is received in opposed sloping slots in the side plates 112 and 114 and the free end of the handle portion 108 is advanced downwardly, the right hand end portion of the upper plate-like member 64 is advanced downwardly to compress walls of the bag-like container 17 to discharge contents thereof.

The side plates 112 and 114 are connected by an upper strap 120 and a lower strap 122. Short bars 124 and 126 are welded to the side plates 112 and 114, respectively. Openings (not shown) in the short bars 124 and 126 and in the front end plate 26 receive fasteners 128 and 130 which mount the housing 110 on the front end plate 26. A pin 132 mounted in openings in the lower strap 122 and in a flange 134 of the front end plate 26 lock the housing 110 in position.

Figure 7:
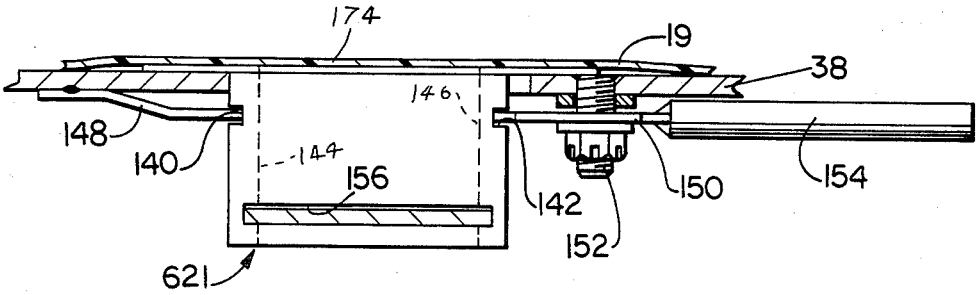
FIG. 7 is a view in section taken on an enlarged scale on the line 7—7 in FIG. 2.

The spout portion 621 includes a tubular generally rectangular body 136 and an annular flange 138 at an upper end of the hollow body 136. The annular flange 138 is adhesively attached to an outer face of the flexible wall 19. The spout portion 621 is provided with locking slots 140 and 142 (FIG. 7) in opposite walls 144 and 146, respectively, of the spout portion 621. A stationary support 148 mounted on the plate-like member 38 extends into the slot 140 to engage the bottom of the slot 140. A cam-shaped support 150 is rotatably mounted on a stud member 152. The stud member 152 is mounted on the plate-like member 38. A handle 154 mounted on the cam-shaped support 150 can be swung to the full line position of FIG. 5 to bring the cam-shaped support into engagement with the bottom of the slot 142 to lock the spout portion 621 in position on the plate-like member 38.

Figure 5:
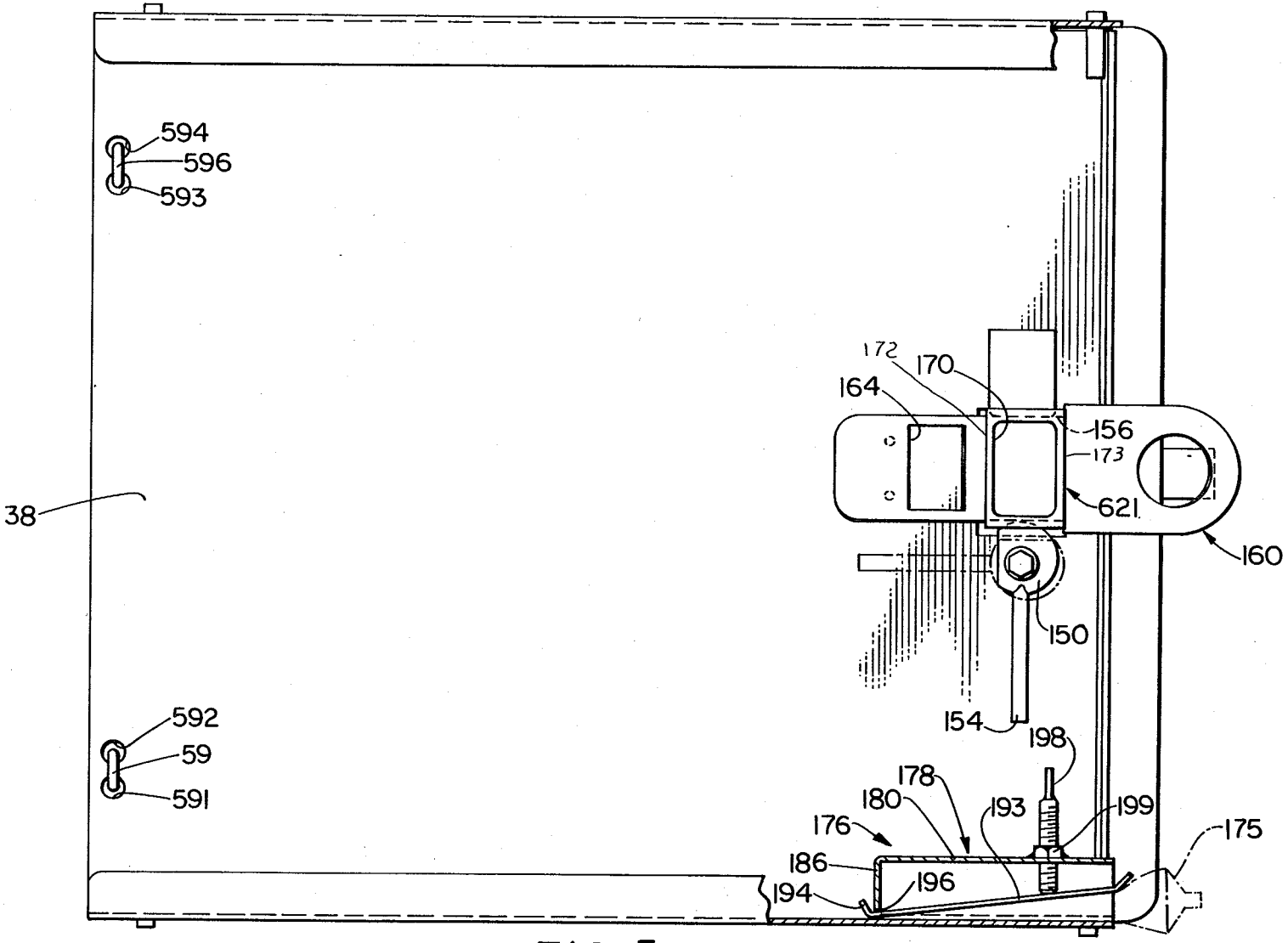
FIG. 5 is a bottom plan view of the machine, portions of a holder for the tube of hardener material being broken away and in section, the tube of hardener material being shown in dot-dash lines, a cam-shaped support being shown in released position in dot-dash lines.
Figure 10:
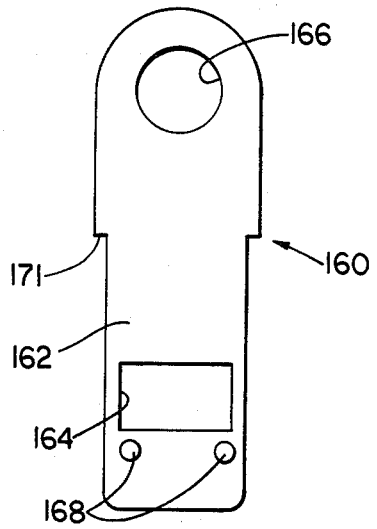
FIG. 10 is a plan view of a valve plate of the machine.

A slot 156 in the spout portion 621 receives a valve plate 160. The valve plate 160 (FIG. 10) includes a body 162 in which a valve opening 164 and a finger opening 166 are formed. Stop dimples 168 are formed in the body 162. When the valve plate 160 is in the position shown in FIG. 5, the spout portion 621 is closed. The valve plate 160 can be advanced to the right as shown in FIG. 5 to bring the valve opening 164 into alignment with a central opening 170 in the spout portion 621. The stop dimples 168 can engage a face 172 of the spout portion 621 to limit movement of the valve plate 160 to the right. Movement of the valve plate 160 to the left is limited when shoulders 171 on the valve plate 160 engage a wall 173 of the spout portion 621. When the bag-like container 17 is to be opened, a portion 174 of the wall 19 of the bag-like container 17 as indicated in FIG. 2, can be cut away inside the spout portion 621 to form a flap inside the spout portion 621.

Figure 3A:
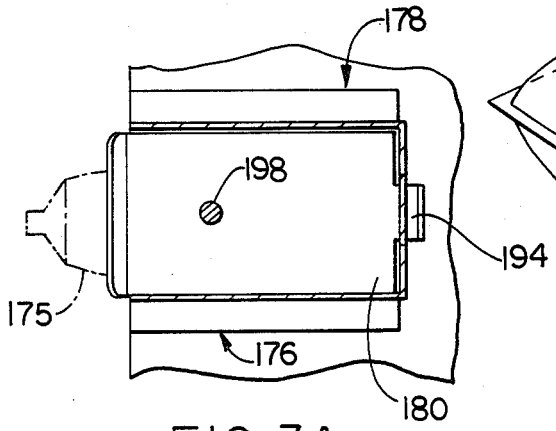
FIG. 3A is a view in section taken on the line 3A—3A in FIG. 3, a tube of hardener material being shown in dot-dash lines.
Figure 4:
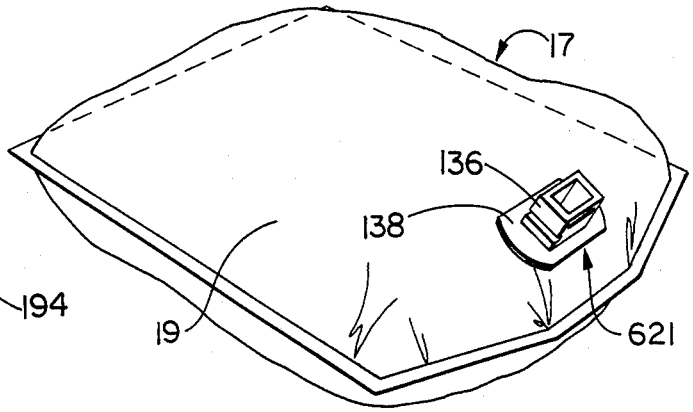
FIG. 4 is a perspective view of a bag-like container from which plastic material is dispensed.

The material discharged from the bag-like container 621 can be of the type of material used to fill imperfections and mars in the surface of a panel of a motor vehicle. Such material can require addition of small amounts of a hardener plastic material. A tube 175 of hardener material can be held in a hanger 176 (FIG. 3A). The hanger 176 includes a main member 178 including a main plate 180 (FIG. 5), side plates 182 and 184 (FIG. 3), a rear plate 186 (FIG. 5), and flanges 188 and 190 mounted on the side plates 182 and 184, respectively. The flanges 188 and 190 are attached to the side plate 24, as by welding. A pressure plate 192 is mounted inside the main member 178. A tab 194 at an end of the pressure plate 192 extends through a slot 196 to hold the pressure plate 192 in position. The pressure plate 192 can bear on the tube 175 as shown in FIG. 5. A thumb screw 198 threaded in a nut 199 attached to themain plate 180 bears on the pressure plate 192 and can be advanced to squeeze the tube 175 and cause discharge of the hardener material as needed.

As shown in FIG. 2, the upper face 60 of the lower plate-like member is slightly concave. A lower face 202 of the upper plate-like member 64 is convex. The radius of curvature of the lower face 202 is less than the radius of curvature of the face 60 of the lower plate-like member so that the face 202 rolls as it works on the upper face of the plate-like member 38, and squeezing of the bag-like container progresses to the right as shown in FIG. 2 with a rolling motion as the contents of the bag-like container are expressed.

The machine illustrated in the drawings and described above is subject to structural modification without departing from the spirit and scope of the appended claims.

Having described our invention, what we claim as new and desire to secure by letters patent is:

1. A machine for causing discharge of plastic material from a bag-like container having flexible walls which comprises a framework, a first plate-like member, means pivotally mounting the first plate-like member adjacent an edge thereof on the framework, spring means urging the first plate-like member to swing about the pivotally mounting means thereof, a second plate-like member pivotally mounted on the framework remote from the pivotally mounting means of the first plate-like member and adjacent a free edge of the first plate-like member, the spring means urging a free edge of the first plate-like member toward the pivot of the second plate-like member to grip the bag-like container therebetween, and means for urging a free edge of the second plate-like member toward the first plate-like member to squeeze the bag-like container, there being spout means receiving contents of the bag-like container as the bag-like container is squeezed.

2. A machine as in claim 1 in which the second plate-like member has a convex lower face working with an upper face of the first plate-like member to cause pressure on the bag-like container to proceed from the pivot of the second plate-like member progressively along the bag-like container to the opposite end thereof as the free edge of the second plate-like member is urged toward the first plate-like member.

3. A machine as in claim 2 in which the first plate-like member has a concave upper face working with the convex lower face of the second plate-like member, the radius of curvature of the upper face of the first plate-like member being greater than the radius of curvature of the lower face of the second plate-like member.

4. A machine as in claim 1 in which the spring means includes a tension spring member connecting the framework to the first plate-like member.

* * * * *